United States Patent [19]

Anderson

[11] Patent Number: 5,077,705

[45] Date of Patent: Dec. 31, 1991

[54] TIDE CLOCK ASSEMBLY WITH OPTICAL DEVICE PROVIDING THE APPEARANCE OF RISING AND FALLING FLUID

[76] Inventor: John Anderson, 236 Grant Ave., Cresskill, N.J. 07626

[21] Appl. No.: 593,081

[22] Filed: Oct. 5, 1990

[51] Int. Cl.[5] ..... G04B 19/26; G04B 49/00

[52] U.S. Cl. ..... 368/19

[58] Field of Search ..... 368/19; 116/26, DIG. 45

[56] References Cited

U.S. PATENT DOCUMENTS 3,703,804 11/1972 Appelberg ..... 368/19

4,623,259 11/1986 Oberst ..... 368/19

4,849,949 7/1989 Voth ..... 368/19

*Primary Examiner*—Bernard Roskoski

*Attorney, Agent, or Firm*—McGlew & Tuttle

[57] ABSTRACT

A device for displaying the present tide level in relation to high and low tide. The display using a clear rod and colored elements in a manner to give the impression of fluid in a rod and the height of the fluid representing the present tide level. The colored elements being moved passed the clear rod by a cut assembly. One of the colored elements being used represents the tide level when rising and the other represents the tide level when falling. The tide level can be displayed in hours to high or low tide.

12 Claims, 3 Drawing Sheets

TIDE CLOCK ASSEMBLY WITH OPTICAL DEVICE PROVIDING THE APPEARANCE OF RISING AND FALLING FLUID

FIELD OF THE INVENTION

The present invention relates in general to a tide clock and more particularly to a new and useful tide clock assembly including a tide clock mechanism and an indicator simulating the rising and falling water level during each tide.

BRIEF DESCRIPTION OF RELATED PRIOR ART

U.S. Pat. No. 4,623,259 issued Nov. 18, 1986, discloses a tide timer including a case, a tidal disk and a timepiece or movement device. A faceplate is provided over the assembly which provides a longitudinal window. The opposite ends of the longitudinal window denote tidal high and low water levels. The disk preferably bears a symmetrical figure which forms part of the tidal water level imitation which is seen through the longitudinal window. Upon rotational movement imparted by the tidal clock, the disk rotates causing the symmetrical figure to rotate, thereby providing the appearance of a changing water level in the window.

This arrangement relies on a symmetrically shaped form to provide the water level simulation. The form is printed on a rotating disk which is driven by the movement or tidal clock mechanism. However, even the provision of a complicated shape still provides a visual indication which is slanted as seen through the display opening.

Other tide timers are known which are mostly in the nature of the synchronized combination of solar and lunar time clocks in which driven hands indicate the passing solar and lunar time on coordinated dials. For example, U.S. Pat. No. 3,708,971 issued to Woldyka teaches a time indicating arrangement which indicates both solar time and the time that will elapse before the next high and low tide. A tide scale is provided with distributive inidicia representing predetermined time periods. A coupling device is provided which is responsive to a clock movement for producing relative movement between the rotary hour indicator and the time indicator. The coupling includes a rotary drive for producing relative rotational movement at a velocity of substantially 0.0805/N revolutions per hour, where N represents an integer.

U.S. Pat. No. 3,703,804 issued to Appleberg represents a tide indicator clock in which a disk is provided which is rotatively driven by a tide clock movement or the like. The disk or dial has a face with indicia indicating the tide status from low tide to high tide. The low tide side of the disk is provided with a light indicia with the side opposite the low tide indicia being provided with a dark indicia designating high tide. Between the high and low tide indicia, the disk progressively changes indicating the change in tide status.

SUMMARY AND OBJECT OF THE INVENTION

It is an object of the invention to provide a time clock arrangement which provides an indicator which has the appearance of water and which provides information on the time from or to low and high tide.

It is a further object of the invention to provide a tide clock construction which has a desirable appearance but which is easy to assemble.

According to the invention, a tide clock assembly is provided comprising a substantially cylindrical base with walls defining an inner space for receiving a tide clock movement. A tide clock movement is provided, positioned within and supported by the base. A cylindrical element is provided comprising a cylindrical surface element with indicia thereon. The indicia preferably includes a colored triangular zone and a white or non-colored zone surrounding the triangular zone. The colored triangular zone is preferably divided into a first and second color zone. The border between the first colored zone and the non-colored zone running at an angle and representing a side for the hypotenuse of the triangle. The border between the second colored zone and the non-colored zone also lies along an angle and represents the hypotenuse of the triangle forming the second colored zone. A faceplate is provided with a window running in a longitudinal direction. On each side of the window, indicia may be provided designating the hours to high or low tide. An optical element is positioned within the window. The cylindrical element is connected to the clock movement for rotation about a central longitudinal axis of the cylinder. The faceplate is positioned in front of the cylinder for viewing the colored indicia on the cylinder through the optical device positioned in the window. The optical device changes the angle of the indicia into a horizontal line due to a prismatic effect of the optical device. The rotation of the cylinder by the time clock movement causes the colored indicia to move relative to the window providing the appearance of a rising and falling water level.

Preferably, the optical device is in the form of a lucite rod which allows light to pass through it but which distorts the light such that the angle of the colored indicia is changed and such that the indicia appears to be fluid contained in the rod.

A further object of the invention is to provide a tide clock arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
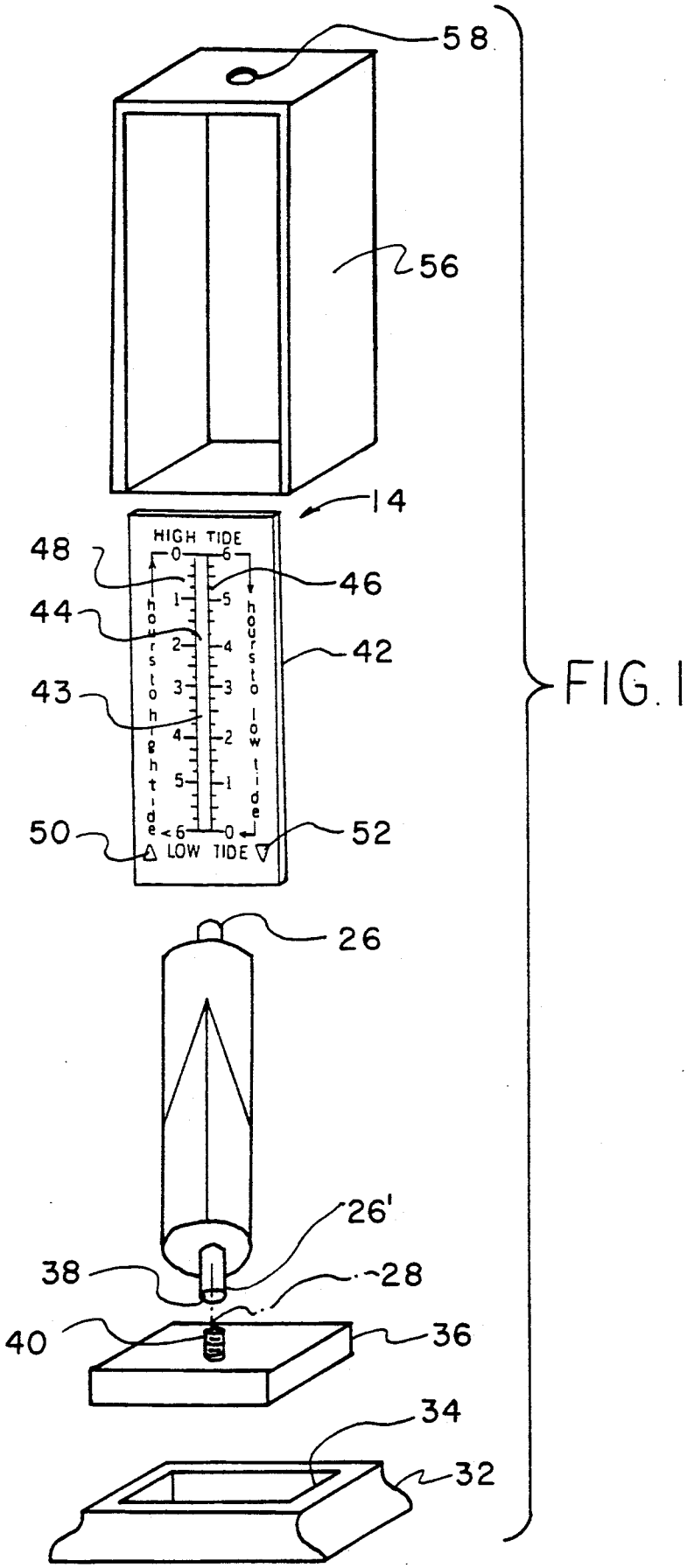
FIG. 1 is an exploded view of the tide clock assembly according to the invention.
Figure 2:
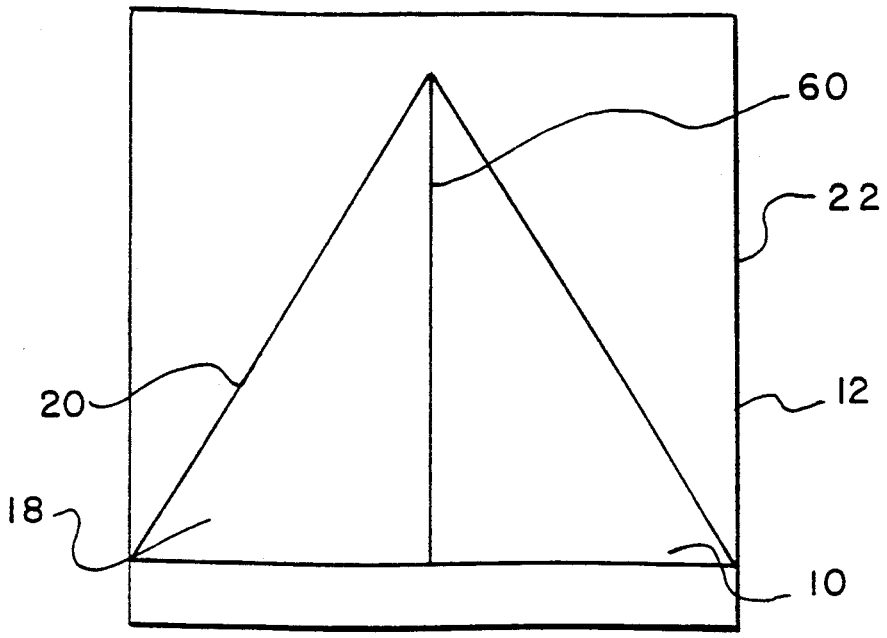
FIG. 2 is a front view of a tube indicator element in a flattened state.
Figure 3:
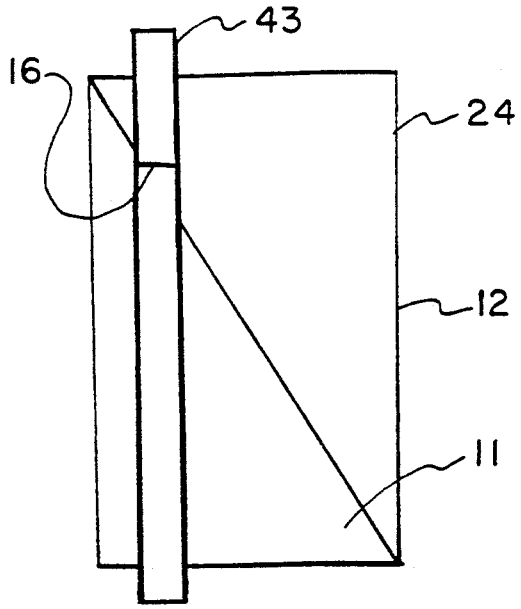
FIG. 3 is a front view of an indicator element having an angled edge positioned behind an optical rod.

Referring to the drawings and in particular to FIGS. 1, 2 and 3, the invention comprises a display medium generally designated 22 including a colored element designated 10 which defines a first indicator line 12. The first indicator line 12 is preferably a straight line extending from one corner of the colored element 10 toward another. According to the invention, the colored element 10 cooperates with an optical means generally designated 4 to provide a conditioned indicator line 16.

The conditioned indicator line 16 is provided to indicate the level of water relative to high and low tides, more specifically to indicate the time between the present tide level and one of high and low tide. Accordingly, movement of the colored element 10 past the optical means 14 from one corner to another occurs at a rate of approximately 6 hours, 12.5 minutes in accordance with the cycle which repeats itself 4 times in a lunar day (24 hours 50 minutes) in accordance with the change of tides.

According to the invention, it is possible to change any one of, the angle of the first indicator line 12, the speed of movement of the colored element 10 relative to the optical means 42 and the length of the first indicator line 12 or the distance along optical means 42 designating the high and low tide.

Tide movements are commercially available calibrated to rotational or disk type displays. Disk displays are in the form of a watch face having a circle divided up into tide segments such as high tide, half tide, low tide, half tide. According to the invention, standard tide movement assemblies may be employed in cooperation with the colored element 10, and optical means 14 described with reference to FIGS. 1, 2 and 3. Such a standard tide movement assembly may be employed as the driving element for moving the colored element 10 by positioning colored element 10 around a circle or support in the form of a cylinder to represent both an increase of water level and decrease of water level. The invention provides an additional colored element 18 having a second indicator line 20 pointing in a direction substantially opposite to indicator line 12 for indicating tide movement opposite to that indicated by colored element 10. The invention preferably includes a display medium such as paper element 22 on which colored elements 10 and 18 are formed. According to a preferred form of the invention, the colored element 10 is red and the colored element 18 is green. Colors are chosen for extreme contrast between the two indicator elements. With this contrast, the different colors displayed through the optical means 14 may be interpreted as either a rise in water level, low tide to high tide, or the reverse. It is possible according to the invention to provide different patterns or combinations of colors for each of the colored elements 10 and 18, and indicator elements 12 and 20 may also be provided having the same color (green or blue designating a water color). However, this will not provide information with regard to direction of the water and will only provide information with regard to the status of the water level relative to the high and low tide. The background color of paper element 22, or other medium, is preferably white or a color or pattern which clearly distinguishes it form the colored indicator elements 12 and 18. The medium may be provided in the form of a plastic or film element and may be transparent.

Referring to FIG. 2 in particular, a preferred construction of the tide clock according to the invention is shown. The paper element 22 having thereon the colored elements 10 and 18 is formed into a tube 24. Alternatively, a pre-formed tube may be used and the colored elements 10 and 18 may be applied to the pre-formed tube.

Tube 24 is provided with upper and lower bearing elements 26 and 26' (FIG. 1) which have a central axis which extends through the tube and provides a central rotational axis 28. The bearing elements may be an integral part of a plastic end plate or molded plastic structure including end plate 30 and integrally formed bearing element 26'.

According to a first embodiment of the invention, a base element 32 is provided defining a tide clock movement's support housing 34. A commercially available tide clock movement 36 is positioned within the tide clock movement support housing chamber 34. The bearing element 26' may be formed as a cylindrical hollow element with interior threading 38 such that it may receive a male tide clock movement element 40. Of course it is also possible to provide a connection element between bearing element 26 and male tide clock movement 36.

Upon engagement of the male tide clock movement element 40 with the hollow interior threaded portion 38, the tide clock movement may be activated for driving the tube 24 in rotation. The complete rotation of the tube 24 will then occur every 12 hours and 25 minutes, for a total of 2 complete rotations in a 24 hour and 50 minute lunar day.

The preferred embodiment provides an optical means comprising an indicia element or dial face plate 42 which includes a window 44 and first indicia 46 and second indicia 48. First indicia 46 provides an hour to low tide indicator based on the 6 hours and 12.5 minutes between tides. The spacing of the indicator lines and the spacing between high and low tides is based on the speed set by the clock movement and the length of the colored elements. Once the speed of the clock movement is known, the length and the angle of the indicator line of each colored element 10 and 18 is easily determined which provides the high and low end of indicia 46 and 48. The dial face plate 42 preferably also includes incoming or outgoing tide markers such as red arrow marker 50 and green arrow marker 52.

The face dial plate 42 receives the optical means 42 which may be a glass rod 43 and preferably is a clear rod 43 formed of LUCITE. As seen in FIG. 1 the rod 43 is positioned within the window 44 of the dial faceplate 42. The dial faceplate assembly is then positioned in tide clock movement support housing 34 between base support 32 and the tide clock movement 36. The length of the dial faceplate 42 is determined based on the height of the assembly of the tide clock movement 36 and the tube 24. In this way, the base of the colored elements 10 and 18 is aligned with bottom of the window 44 such that the colored elements 10 or 18 may be viewed through the window 44 through the rod 43. Advantageously, a transparent case 56 is provided for enclosing assembly including base 32, movement 36, tube 24 and dial faceplate 42. The case 56 preferably includes a bearing or bearing receiving element 58 which may be in the form of a cup-shaped molded plastic structure with 58 which may be formed integral with the case 56. Cup-shaped structure 58 receives the upper bearing element 26 to provide additional support to the rotating tube 24. A lining of the transparent case may be provided such that only the dial faceplate 42 may be seen from the outside of the case 56.

The assembled tide clock arrangement provides the appearance of fluid in the rod 43 as the colored element 10 can be seen through the window 44 and the indicator line is changed or conditioned by the optical means 14 such that it appears as a horizontal line from the front side of the dial faceplate 42. During rotation of the tube 24 by the tide clock movement 36, the length of colored element 10 progressively increases (clockwise rotation). The combination of elements provides a visual appearance of fluid in a tube and as tide movement rotates the tube 24, it appears that the fluid level within the window 44 is being raised and lowered. As an end edge 60 of the paper element 10 is displayed through the window 44, it appears that no is filled with fluid. Upon further rotation of the tube 24, the second or additional indicator line 20 comes into view as the point 62 of colored element 18 is surpassed. As the tube 24 rotates, the arrangement provides the appearance fluid level in the tube going down. The color as viewed through the optical means 14 provides an indication as to whether the tide is going out or coming in based on the red or green marker arrows 50, 52.

Figure 4:
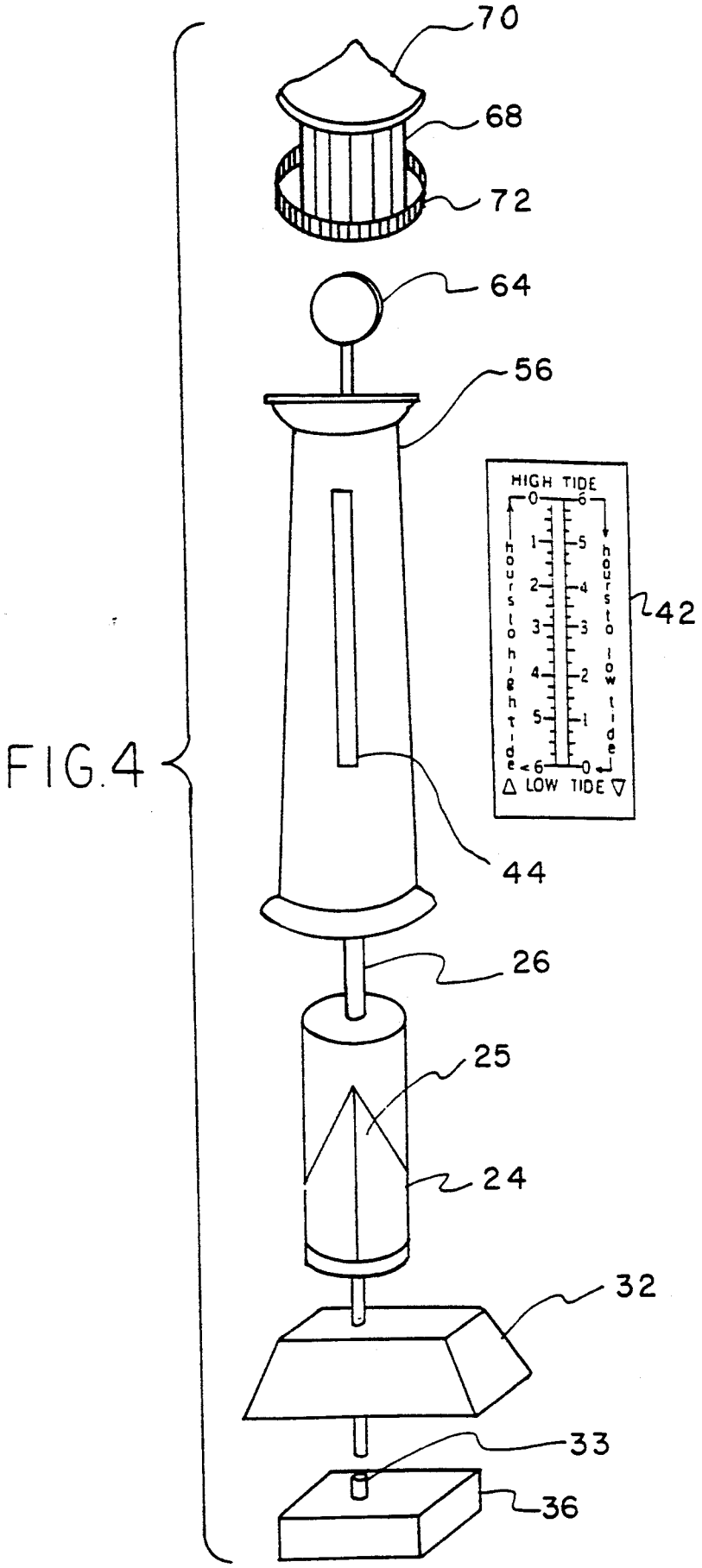
FIG. 4 is a perspective view showing a second embodiment according to the invention.

FIG. 4 shows an alternative arrangement of the invention. Again a commercially available tide clock movement 36 is employed. The tide clock movement 36 is positioned within a base support 32' such that the hour gear shaft 33 and sweep second gear shaft 35 protrude through an opening 37 at the top of the base 32'. A tube 24' is provided which is constructed in a manner which is significantly similar to tube 24 described with regard to FIG. 3. However, a hollow tube 25 is provided within tube 24 and the tube 25 passes through each of the bearing element 26'. The lower bearing element 26' connects to the hour gear shaft 33. An elongate shaft 62 is provided extending through tube 25 and is connected to the sweep second gear shaft 35. The elongate shaft 62 is connected to a beacon element or the like 64 which rotates at approximately one revolution every 62.5 seconds. A housing or case 56' is provided in the shape of a lighthouse structure and is supported by the base 32'. The housing 56' is provided with an opening and according to the second embodiment of the invention, the faceplate 42 (described above) may be connected to the outside of the housing 56' such that the rod 42 carried by the faceplate 42 is aligned with the window or aperture 44'.

At the upper end of housing 56', a top element 66 is positioned. The top housing element 66 is provided with transparent window element 68. The transparent window element 68 is preferably formed of transparent plastic and the top housing element 66 is comprised of plastic element preferably including roof element 70 and railing and floor element 72.

The beacon element 64 may be in the form of a mirror element or a reflecting surface which catches light as it rotates. Alternatively, the beacon 64 may include a small light such as a flashlight connected to an appropriate power source.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

What is claimed is:

1. A tide clock assembly comprising: a colored indicator element having an indicator line extending at an angle relative to horizontal; optical means positioned in front of said colored element for viewing said colored element through said optical means, said optical means conditioning said angled indicator line such that it appears as a substantially horizontal line; said optical means comprising a clear elongate rod and clock movement means for moving said colored element relative to said optical means, whereby the movement of said colored element causes said conditioned horizontal indicator line to move relative to said optical means.

2. A clock assembly according to claim 1, wherein said colored element is formed on a cylindrical tube, said cylindrical tube being connected to said clock movement means for rotation of said cylindrical tube about a central axis, said optical means comprising said clear elongate rod positioned substantially parallel to said tube central axis, whereby said colored element is viewed through said optical means appears as fluid moving within said optical means.

3. A clock assembly according to claim 2, wherein said tube is formed of a white paper element, said colored element being provided on said white paper element in the form of a triangle with an edge of said triangle defining said indicator line, a second colored element being provided on said white paper element in the form of a triangle with an edge of the triangle defining a second colored element indicator line.

4. A clock assembly according to claim 3, wherein said tube includes a lower bearing element connected to a gearshaft of a said clock movement for rotation therewith, said clear rod being supported in a window of an indicator faceplate positioned in front of said cylindrical tube.

5. A clock according to claim 4, wherein said faceplate includes indicia along the length of said window.

6. A clock according to claim 5 wherein said clock movement is supported by a housing, said housing supporting said clock face relative to said tube, a casing being provided and enclosing said tube supported by said housing.

7. A clock according to claim 6, wherein said clock movement is a tide clock movement based approximately on one revolution in 12 hours, 25 minutes, said indicia being disposed along said window based on movement of one of said colored elements pass said window in 6 hours and 12.5 minutes.

8. A clock arrangement according to claim 7, wherein said colored element is a first color and said second color element having a second color, said faceplate including an arrow pointing down having a color of said first colored element and including an arrow pointing up having the color of said second colored element.

9. A clock assembly according to claim 6, wherein said case is a transparent case, said indicator face being positioned with said tube inside said case.

10. A clock arrangement according to claim 6, wherein said case is shaped in the form of a lighthouse, said clock movement including a sweep second hand gearshaft, said two bearing elements including an inner tube extending from one end of said tube to another, a shaft being connected to said sweep second gearshaft and extending through said inner tube, an indicator being connected to said inner shaft and viewable through said casing.

11. A tide clock assembly comprising: a colored indicator element having an indicator line extending at an angle relative to horizontal; optical means positioned in front of said colored element for viewing said colored element through said optical means, said optical means conditioning said angled indicator line such that it appears as a substantially horizontal line; and clock movement means for moving said colored element relative to said optical means, whereby the movement of said colored element causes said conditioned horizontal indicator line to move relative to said optical means, said colored element is formed on a cylindrical tube, said cylindrical tube being connected to said clock movement means for rotation of said cylindrical tube about a central axis, said optical means comprising a clear elongate rod positioned substantially parallel to said tube central axis, whereby said colored element is viewed through said optical means appears as fluid moving within said optical means.

12. A tide clock assembly comprising: a colored indicator element having an indicator line extending at an angle relative to horizontal; optical means positioned in front of said colored element for viewing said colored element through said optical means, said optical means conditioning said angled indicator line such that it appears as a substantially horizontally line; and clock movement means for moving said colored element relative to said optical means, whereby the movement of said colored element causes said conditioned horizontal indicator line to move relative to said optical means, said colored element is formed on a cylindrical tube, said cylindrical tube being connected to said clock movement means for rotation of said cylindrical tube about a central axis, said optical means comprising a clear elongate rod positioned substantially parallel to said tube central axis, whereby said colored element is viewed through said optical means appears as fluid moving within said optical means, said tube is formed of a white paper element, said colored element being provided on said white paper element in the form of a triangle with an edge of said triangle defining said indicator line, a second colored element being provided on said white paper element in the form of a triangle with an edge of the triangle defining a second colored element indicator line, said tube includes a lower bearing element connected to a gearshaft of a said clock movement for rotation therewith, said clear rod being supported in a window of an indicator faceplate positioned in front of said cylindrical tube, said faceplate includes indicia along the length of said window.

* * * * *